US007025321B2

(12) United States Patent
Jung

(10) Patent No.: US 7,025,321 B2
(45) Date of Patent: Apr. 11, 2006

(54) ANTI-FALLING DEVICE FOR REFRIGERATORS

(75) Inventor: Sang-Gyu Jung, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 30 days.

(21) Appl. No.: 10/378,927

(22) Filed: Mar. 5, 2003

(65) Prior Publication Data

US 2004/0046092 A1 Mar. 11, 2004

(30) Foreign Application Priority Data

Sep. 9, 2002 (KR) ..... 2002-54310

(51) Int. Cl.
*F16M 1/00* (2006.01)

(52) U.S. Cl. ..... 248/680; 248/500; 248/681

(58) Field of Classification Search ..... 248/680, 248/500, 220.21, 681, 506
See application file for complete search history.

(56) References Cited

U.S. PATENT DOCUMENTS 3,866,704 A * 2/1975 Bowers et al. ..... 180/68.5
3,912,350 A * 10/1975 Gurubatham ..... 312/276
4,016,612 A * 4/1977 Barile, Sr. ..... 5/200.1
4,526,020 A * 7/1985 Fey et al. ..... 68/3 R
4,940,298 A * 7/1990 Jackson et al. ..... 312/228
4,953,030 A * 8/1990 Seo ..... 348/375
5,076,525 A * 12/1991 Whipple ..... 248/300
5,613,814 A * 3/1997 Jackson ..... 410/70
5,645,258 A * 7/1997 Flowers ..... 248/298.1
6,220,562 B1 * 4/2001 Konkle ..... 248/500
6,244,800 B1 * 6/2001 Studanski ..... 410/3
6,488,253 B1 * 12/2002 Piccolomini ..... 248/505
6,533,238 B1 * 3/2003 Barnes et al. ..... 248/680

FOREIGN PATENT DOCUMENTS

DE 19745090 A1 10/1997

OTHER PUBLICATIONS

Japanese Abstract 10-323249, dated Dec. 8, 1998.
Japanese Abstract 08-334286, dated Dec. 17, 1996.
Japanese Abstract 10-30875, dated Feb. 3, 1998.
Japanese Abstract 2000-245546, dated Sep. 12, 2000.

* cited by examiner

*Primary Examiner*—Ramon O. Ramirez
*Assistant Examiner*—Steven Marsh
(74) *Attorney, Agent, or Firm*—Staas & Halsey LLP

(57) ABSTRACT

An anti-falling device for refrigerators has an improved structure capable of effectively preventing a refrigerator from falling flat on a front thereof despite a heavy door and allowing the cabinet of the refrigerator to move from a wall of a building easily when the rear portion of the cabinet needs to be cleaned or repaired. The anti-falling device is provided at a position between the cabinet of a refrigerator and a wall of a building against which the cabinet stands, thus preventing the cabinet from falling flat on the front. The anti-falling device includes a hooking rod provided on the wall of the building. A rotary hook is rotatably mounted to the cabinet and is engaged with or disengaged from the hooking rod in accordance with a rotation thereof.

8 Claims, 8 Drawing Sheets

ANTI-FALLING DEVICE FOR REFRIGERATORS

CROSS-REFERENCE TO RELATED APPLICATIONS

This application claims the benefit of Korean Application No. 2002-54310, filed Sep. 9, 2002, in the Korean Intellectual Property Office, the disclosure of which is incorporated herein by reference.

BACKGROUND OF THE INVENTION

1. Field of the Invention

The present invention relates, in general, to refrigerators and, more particularly, to an anti-falling device provided in a refrigerator to prevent the refrigerator from falling flat on a front of the refrigerator.

2. Description of the Related Art

As is well known to those skilled in the art, refrigerators are electric appliances that are provided with refrigeration systems and that store food to maintain freshness of the food for a lengthy period of time. As shown in FIG. 1, a conventional refrigerator includes a cabinet 1 that defines an appearance of the refrigerator, with a storage chamber defined in the interior of the cabinet 1 and open at the front. The storage chamber is divided into a freezing compartment and a refrigerating compartment by a partition wall. In the conventional refrigerator, the freezing compartment preferably stores frozen food therein, while the refrigerating compartment preferably stores cold food therein.

A door 2 is mounted to the front of the cabinet 1, thus allowing a user to open the storage chamber. The door 2 is hinged at an inside edge thereof to the front of the cabinet 1, so that the door 2 is rotatable around the hinged joints to open or close the storage chamber.

Several door shelves are installed on the inner surface of the door 2 such that the shelves are arranged in a plurality of parallel stories. Therefore, foods and/or containers containing foods, such as beverage bottles, are preferably stored on the door shelves as well as on the shelves arranged in the storage chamber.

The door 2 is increased in gross weight since the weight of foods stored on the door shelves is added to the net weight of the door 2, so that the center of gravity of the refrigerator is shifted to the front of the cabinet 1, possibly causing the refrigerator to fall flat on the front unexpectedly. Such a possibility of falling flat on the front of the refrigerator is increased when the heavy door 2 is opened.

In an effort to prevent such a problem of unexpected falling of the refrigerator, an anti-falling device 4 according to an embodiment of the conventional art may be used with a refrigerator, as shown in FIG. 1.

The anti-falling device 4 for refrigerators includes a support bracket 5 that is mounted to a wall 3 of a building by using a setscrew 5*a*. The anti-falling device 4 also includes a support member 6 that is mounted to the bracket 5 by driving another setscrew 5*a* to hold tightly the rear portion of the top wall of the refrigerator's cabinet 1, which stands against the wall 3.

If the upper portion of the refrigerator leans forward to fall flat on the front due to the heavy door 2, the rear portion of the top wall of the cabinet 1 is stopped by the support member 6 of the anti-falling device 4, preventing the refrigerator from falling flat on the front.

In addition to the anti-falling device 4 of FIG. 1, another anti-falling device 7 has been proposed and used, as shown in FIG. 2. As shown in the drawing, the anti-falling device 7 according to the second embodiment of the conventional art provides that the cabinet 1 of a refrigerator is directly screwed, using a setscrew 9, to a support member 8 that is mounted to a wall 3 against which the refrigerator stands.

That is, the anti-falling device 7 of FIG. 2 includes a support member 8 that is mounted to a wall 3 and a setscrew 9 that fixes a predetermined portion of the top wall of the cabinet 1 to the support member 8. Therefore, the anti-falling device 7 directly holds the cabinet 1 to the support member 8 mounted to the wall 3.

Refrigerators are typically installed in rooms of buildings while standing against walls 3, with the rear wall of a cabinet 1 placed close to a wall 3 without leaving a substantial space between the cabinet 1 and the wall 3. Therefore, when the rear portion of the cabinet 1 needs to be cleaned or repaired, a user must move the refrigerator away from the wall 3 to create a substantial space between the cabinet 1 and the wall 3.

However, when an anti-falling device 4 or 7 is used and a refrigerator must be moved away from a wall 3 to clean or repair the rear portion of the cabinet 1, a problem occurs.

That is, in the anti-falling device 4 of FIG. 1, the support member 6 tightly holds the rear portion of the top wall of the refrigerator's cabinet 1 and prevents the cabinet 1 held by the anti-falling device 4 from being moved away from the wall 3. Therefore, in order to move the cabinet 1 from the wall 3, the setscrew 5*a* must be unscrewed and the support member 6 must be removed from the bracket 5 prior to moving the cabinet 1. After cleaning or repairing the rear portion of the cabinet 1, the cabinet 1 is moved backward to a position close to the wall 3, and the support member 6 is mounted to the bracket 5 by driving the setscrew 5*a* again. The anti-falling device 4 is thus inconvenient for a user who wants to move the refrigerator.

In the anti-falling device 7 of FIG. 2, the cabinet 1 of a refrigerator is fixed to the support member 8 by using a setscrew 9, preventing the cabinet 1 held by the anti-falling device 7 from being moved away from the wall 3. Therefore, in order to move the cabinet 1 from the wall 3 to clean or repair the rear portion of the cabinet 1, the setscrew 9 must be removed to separate the cabinet 1 from the support member 8. After cleaning or repairing the rear portion of the cabinet 1, the cabinet 1 is moved backward to a position close to the wall 3, and the cabinet 1 is fixed again to the support member 8 by driving the setscrew 9. This anti-falling device 7 is thus inconvenient for a user.

SUMMARY OF THE INVENTION

Accordingly, it is an aspect of the present invention to provide an anti-falling device for refrigerators which has an improved structure capable of effectively preventing a refrigerator from falling flat on a front irrespective of a heavy door, and allowing the cabinet of the refrigerator to move easily from a wall of a building when the rear portion of the cabinet needs to be cleaned or repaired.

Additional aspects and advantages of the invention will be set forth in part in the description which follows and, in part, will be obvious from the description, or may be learned by practice of the invention.

The foregoing and/or other aspects of the present invention are achieved by providing an anti-falling device for refrigerators, provided at a position between a cabinet of a refrigerator and a wall of a building against which the cabinet stands, thus preventing the cabinet from falling flat on the front, including a hooking rod provided on the wall of the building and a rotary hook rotatably mounted to the cabinet and engaged with or disengaged from the hooking rod in accordance with a rotation thereof.

The anti-falling device may further include a first support bracket mounted on the wall of the building for supporting the hooking rod and a second support bracket mounted on a top wall of the cabinet for supporting the rotary hook.

The rotary hook includes a hook part formed by bending a first end of the rotary hook that functions by engaging with or disengaging from the hooking rod, with a hinge shaft mounted to the second support bracket and assembled with the rotary hook at an intermediate position between both ends of the rotary hook, thus rotatably mounting the rotary hook to the second support bracket.

The rotary hook also includes an actuating part at a second end thereof, opposite to the first end having the hook part, with an elastic biasing member connecting the actuating part to a predetermined portion of the second support bracket to pull the actuating part to rotate the rotary hook around the hinge shaft in a direction opposite to the hooking rod. The second support bracket of the anti-falling device is provided at a predetermined position on the cabinet with an upwardly extended holding part to hold an end of the biasing member.

In accordance with another aspect, the present invention provides an anti-falling device for refrigerators that is provided at a position between a cabinet of a refrigerator and a wall of a building against which the cabinet stands to prevent the cabinet from falling flat on the front. The anti-falling device includes a support bracket mounted on the wall of the building, a guide member held at an end thereof by the wall of the building using the support bracket, with a guide channel formed in the guide member such so that the guide channel extends to a predetermined length in a direction extending from a rear to the front of the cabinet, and a guide pin mounted to an external surface of the cabinet while passing the guide channel to move the guide pin along the guide channel in opposite directions. The guide pin has a head with a size larger than a width of the guide channel.

The support bracket of the above anti-falling device includes a hooking part formed by bending a predetermined portion of the support bracket to provide a predetermined distance between the hooking part and the wall of the building. The guide member includes a hook part formed by bending the end of the guide member, wherein the hook part is engaged with or disengaged from the hooking part of the support bracket.

In accordance with a further aspect, the present invention provides an anti-falling device for refrigerators that is provided at a position between a cabinet of a refrigerator and a wall of a building against which the cabinet stands to prevent the cabinet from falling flat on the front. The anti-falling device includes an elastic member connecting an external surface of the cabinet to the wall of the building. The anti-falling device further includes a guide member connected to a first end of the elastic member, a first support bracket mounted on a top wall of the cabinet and having a guide member reception part to receive the guide member to move the guide member under the guide of the first support bracket in a direction extending from the front to a rear of the cabinet. A guide slit formed along the guide member reception part guides a movement of the first end of the elastic member, and a second support bracket mounted on the wall of the building functions to support a second end of the elastic member. The guide slit of the anti-falling device is open at an end thereof directed toward the front of the cabinet. The elastic member of the anti-falling device may be a compression spring.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
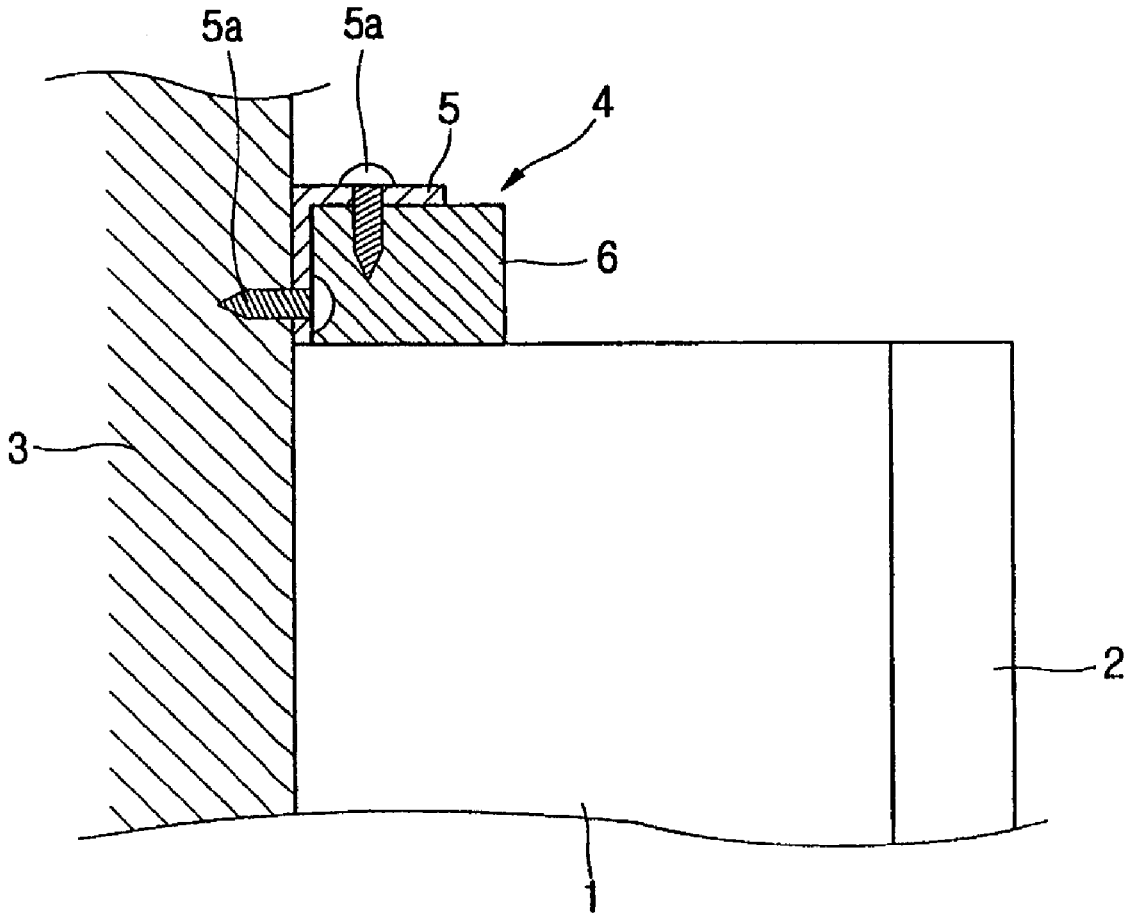
FIG. 1 (PRIOR ART)
FIG. 1 is a sectional view showing construction of an anti-falling device for refrigerators in accordance with an embodiment of the conventional art.
Figure 2:
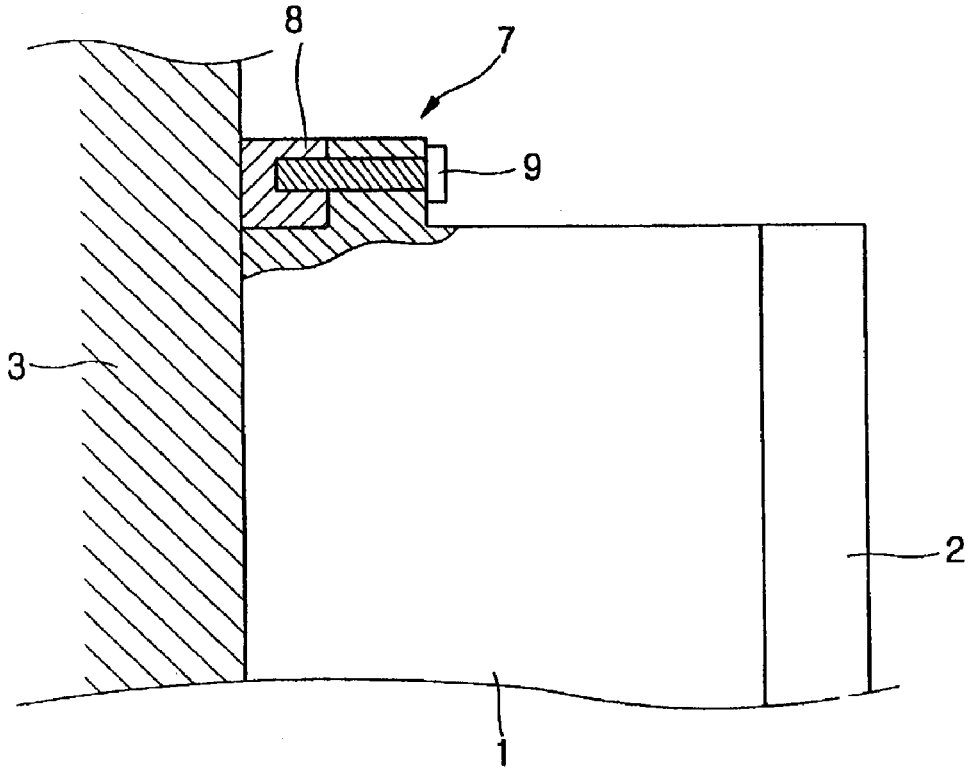
FIG. 2 (PRIOR ART)
FIG. 2 is a sectional view showing construction of an anti-falling device for refrigerators in accordance with another embodiment of the conventional art.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 3:
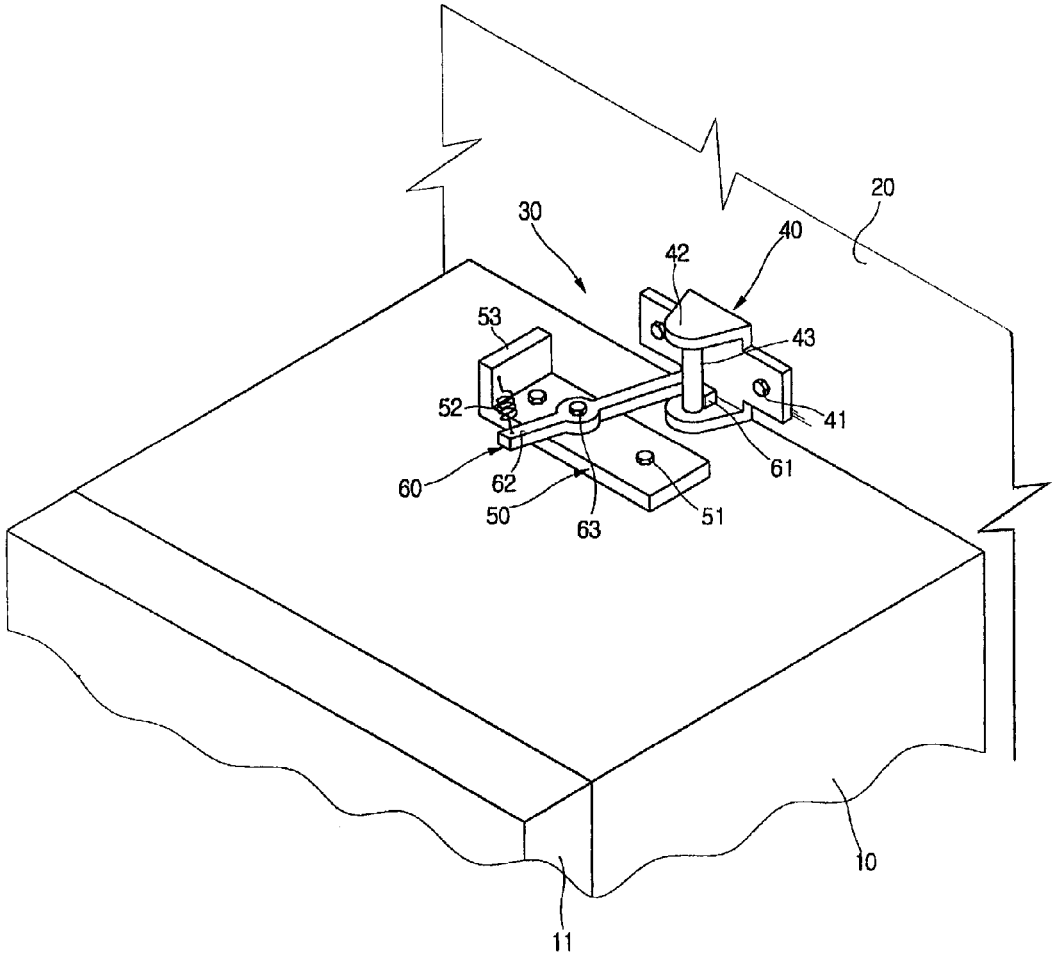
FIGS. 3 and 4 are perspective views showing construction and operation of an anti-falling device for refrigerators in accordance with a first embodiment of the present invention.

The refrigerator of the present invention is provided with a refrigeration system and stores food therein to maintain freshness of the food for a lengthy period of time. As shown in FIG. 3, the refrigerator includes a cabinet 10 that defines an appearance of the refrigerator, with a storage chamber defined in the interior of the cabinet 10 and open at the front. A door 11 is mounted to the front of the cabinet 10, thus allowing a user to open the storage chamber. The refrigerator is installed in a room of a building while standing against a wall 20, with the rear wall of the cabinet 10 placed closely to the wall 20 without leaving a substantial space between the cabinet 10 and the wall 20.

The door 11 is hinged at an inside edge thereof to the front of the cabinet 10 to allow the door 11 to rotate around the hinged joints to open or close the storage chamber. Several door shelves (not shown) are installed on the inner surface of the door 11 such that the shelves are arranged in a plurality of parallel stories. Therefore, foods and/or containers containing foods, such as beverage bottles, are preferably stored on the door shelves as well as on the shelves arranged in the storage chamber.

The door 11 is increased in gross weight since the weight of foods stored on the door shelves (not shown) is added to the net weight of the door 11, shifting the center of gravity of the refrigerator to the front of the cabinet 10 and the refrigerator may unexpectedly fall flat on the front. In an effort to prevent such a problem of unexpected falling flat on the front of the refrigerator, an anti-falling device is installed at a position between the top wall of the cabinet 10 and the wall 20 against which the refrigerator stands.

The anti-falling device for refrigerators in accordance with one embodiment of the present invention has an improved structure capable of effectively preventing the cabinet 10 from falling flat on the front despite the heavy door 11 and allowing the cabinet 10 to be moved away from the wall 20 easily when the rear portion of the cabinet 10 needs to be cleaned or repaired. A variety of anti-falling devices having the above functions is described in accordance with the embodiments of the present invention. An anti-falling device 30 for refrigerators in accordance with first embodiment of the present invention is described herein below, with reference to FIGS. 3 and 4.

Figure 4:
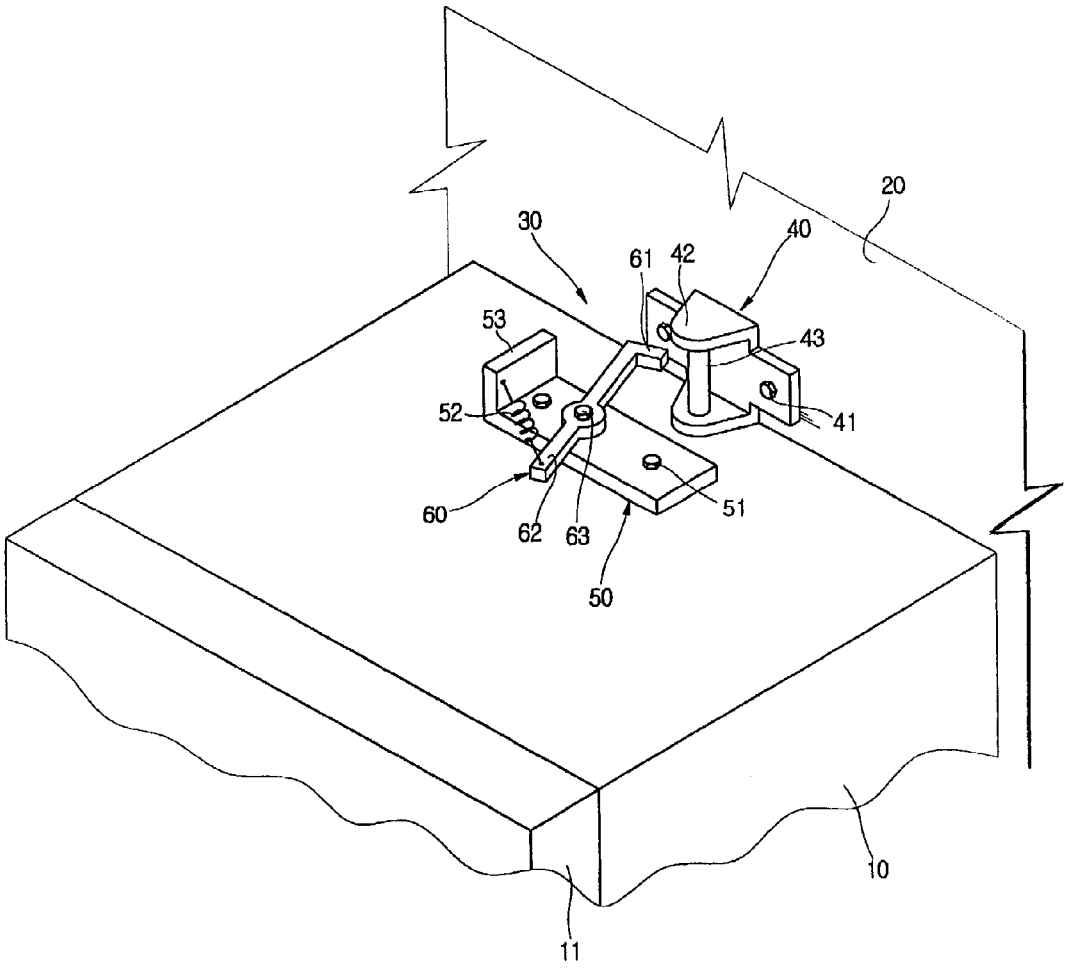

As shown in FIGS. 3 and 4, the anti-falling device 30 for refrigerators according to the first embodiment of the present invention includes a first support bracket 40 and a second support bracket 50. The first support bracket 40 is mounted to the wall 20 of a building at a position near the top wall of the cabinet 10. The second support bracket 50 is mounted to the top wall of the cabinet 10. The first and second support brackets 40 and 50 of the anti-falling device 30 are mounted to the wall 20 of the building and the top wall of the cabinet 10 by using setscrews 41 and 51, respectively.

The first support bracket 40 includes a main body, with upper and lower extensions 42 integrally extending from the middle portions of the upper and lower edges of the main body and being perpendicular to the main body. A hooking rod 43 extends between the upper and lower extensions 42.

A longitudinal rotary hook 60 is hinged to the second support bracket 50 to engage the rotary hook 60 with the hooking rod 43 of the first support bracket 40. The rotary hook 60 includes a hook part 61 and an actuating part 62. The hook part 61 is formed by bending a first end of the longitudinal rotary hook 60, forming the actuating part at the second end of the rotary hook 60. The rotary hook 60 is hooked at the hook part 61 by the hooking rod 43 of the first support bracket 40. The longitudinal rotary hook 60 is hinged to the second support bracket 50 at an intermediate portion of the hook 60 by using a hinge shaft 63. The hinge shaft 63 thus rotatably mounts the longitudinal rotary hook 60 to the second support bracket 50 and functions as a rotating shaft of the rotary hook 60 during a rotation of the rotary hook 60 on the second support bracket 50.

A biasing member 52 connects the actuating part 62 of the longitudinal rotary hook 60 to a predetermined portion of the second support bracket 50. The biasing member 52 elastically pulls the actuating part 62 to rotate the rotary hook 60 relative to the second support bracket 50 around the hinge shaft 63 in a direction opposite to the hooking rod 43. For example, the rotary hook 60 is rotated in a clockwise direction in the drawings, where the hook part 61 of the rotary hook 60 is brought into, and maintains engagement with, the hooking rod 43 of the first support bracket 40 when no external force is applied to the rotary hook 60. In order to hold an end of the biasing member 52 easily, one end of the second support bracket 50 is bent upward to form a holding part 53.

In a normal state of the anti-falling device 30 with no external force applied to the rotary hook 60, the biasing member 52 pulls the rotary hook 60 to engage the hook part 61 of the rotary hook 60 with the hooking rod 43 of the first support bracket 40 and maintains stable engagement. The anti-falling device 30 thus effectively prevents the cabinet 10 of the refrigerator from falling flat on the front even when the center of gravity of the refrigerator is shifted to the front of the cabinet 10.

When the rear portion of the cabinet 10 needs to be cleaned or repaired, the cabinet 10 must be moved away from the wall 20 to create a substantial space between the cabinet 10 and the wall 20. In such a case, the rotary hook 60 is rotated slightly in a direction, for example, a counter-clockwise direction in the drawings, overcoming the restoring force of the biasing member 52 and disengaging the hook part 61 of the rotary hook 60 from the hooking rod 43 of the first support bracket 40, as shown in FIG. 4. When the hook part 61 of the rotary hook 60 disengages from the hooking rod 43 of the first support bracket 40, the cabinet 10 may be moved away from the wall 20 easily. Therefore, the anti-falling device 30 is not disassembled from the cabinet 10 or the wall 20 when moving the cabinet 10 away from the wall 20. After cleaning or repairing the rear portion of the cabinet 10, the cabinet 10 is moved backward to a position close to the wall 20, and the rotary hook 60 is actuated to engage the hook part 61 of the rotary hook 60 with the hooking rod 43 of the first support bracket 40 and to maintain stable engagement. The anti-falling device 30 in the above state stably holds the cabinet 10 against the wall 20 while preventing the cabinet 10 from falling flat on the front.

Figure 5:
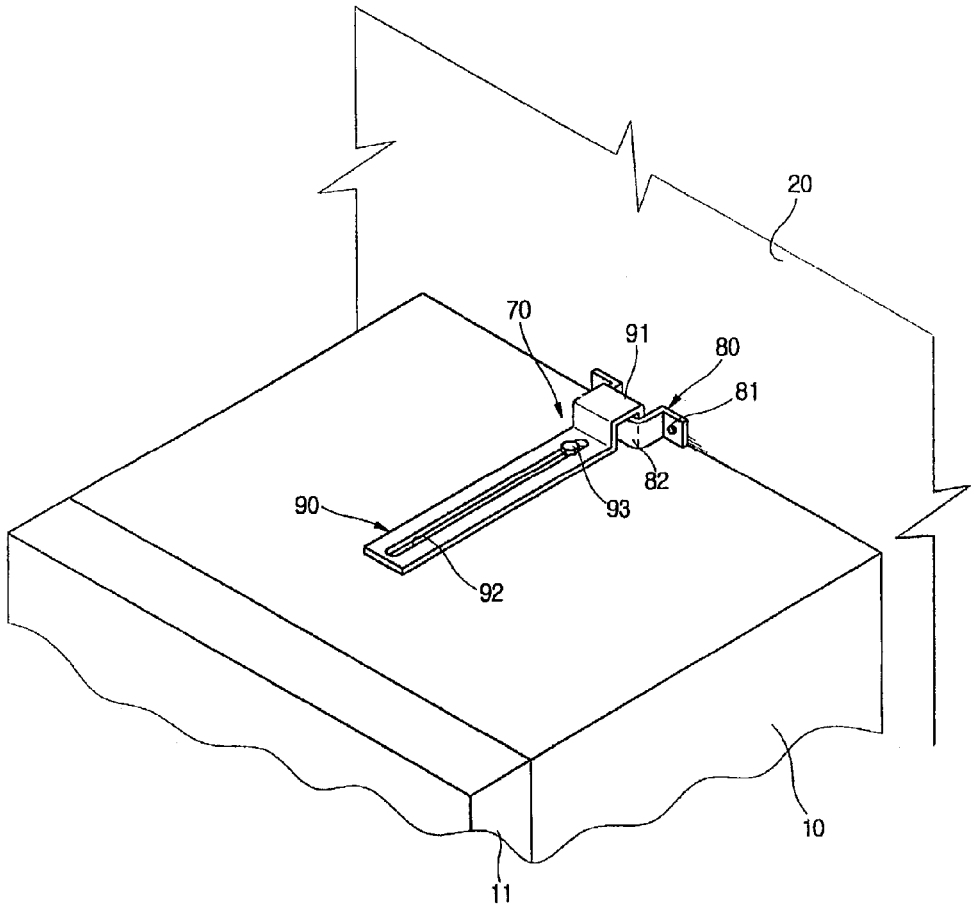
FIG. 5 is a perspective view showing construction of an anti-falling device for refrigerators in accordance with a second embodiment of the present invention.
Figure 6:
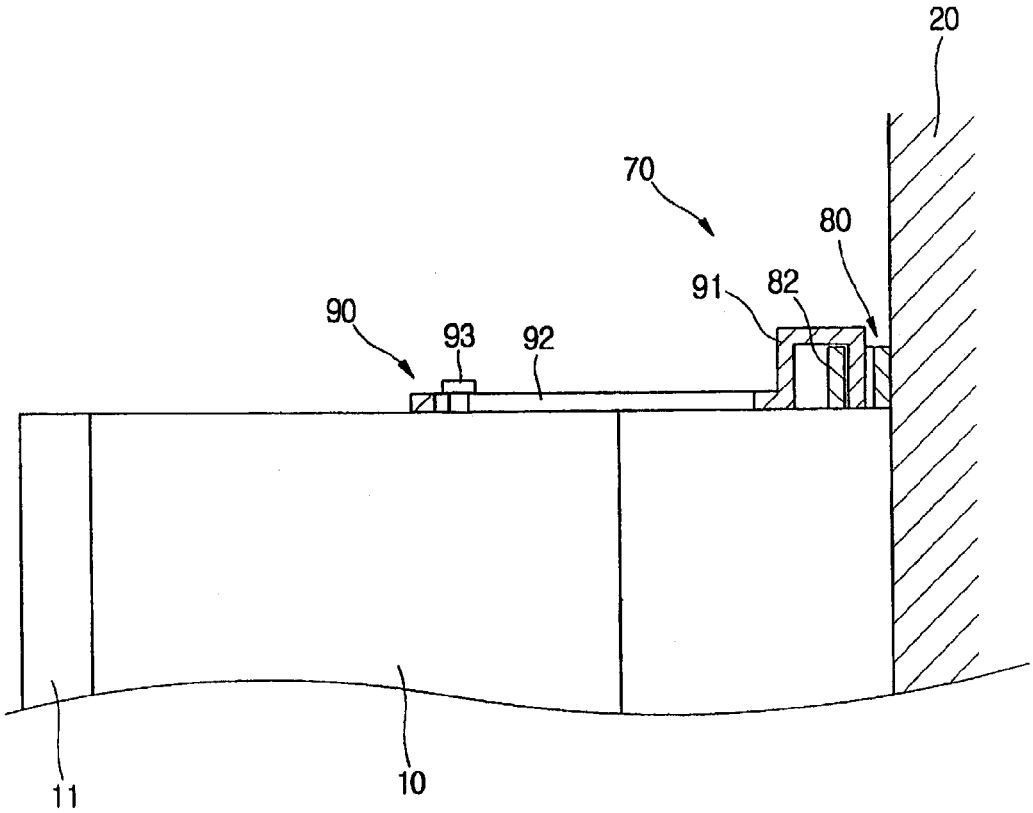
FIG. 6 is a sectional view showing construction of the anti-falling device in accordance with the second embodiment of the present invention.

An anti-falling device 70 for refrigerators in accordance with a second embodiment of the present invention will be described herein below, with reference to FIGS. 5 and 6. As shown in FIGS. 5 and 6, the anti-falling device 70 for refrigerators according to the second embodiment of the present invention includes a support bracket 80 and a longitudinal guide member 90. The support bracket 80 is mounted, using setscrews 81, to a wall 20 of a building at a position near the top wall of the cabinet 10. The longitudinal guide member 90 is arranged on the top wall of the cabinet 10 in a direction extending from the rear wall to the front wall of the cabinet 10. The support bracket 80 is bent at a middle portion thereof to form a hooking part 82 that is spaced apart from the wall 20 by a predetermined distance when the support bracket 80 is screwed to the wall 20 at both ends of the bracket 80. The longitudinal guide member 90 is bent at an end thereof close to the support bracket 80, thus forming a hook part 91 that is hooked by the hooking part 82 of the support bracket 80.

The longitudinal guide member 90 has a guide channel 92 having a predetermined length. The guide channel 92 is formed along the central axis of the guide member 90 to guide a movement of the cabinet 10 relative to the wall 20 of a building. A guide pin 93 is mounted to the top wall of the cabinet 10 and moves along the guide channel 92 in opposite directions when the cabinet 10 is moved relative to the wall 20.

The head of the guide pin 93 preferably has a size larger than the width of the guide channel 92. Due to the head, the guide pin 93 prevents the guide member 90 from being removed from the top wall of the cabinet 10 and moves along the guide channel 92 to guide a movement of the cabinet 10 when the cabinet 10 is moved relative to the wall 20.

In a normal state of the anti-falling device 70 according to the second embodiment, the guide member 90, supported on the top wall of the cabinet 10 by the guide pin 93, is locked to the support bracket 80 mounted to the wall 20 of a building. Therefore, the anti-falling device 70 effectively prevents the cabinet 10 of the refrigerator from falling flat on the front even when the center of gravity of the refrigerator is shifted to the front of the cabinet 10.

When the rear portion of the cabinet 10 needs to be cleaned or repaired, the cabinet 10 is moved away from the wall 20 to create a substantial space between the cabinet 10 and the wall 20. Then, the anti-falling device 70 stably guides a forward movement of the cabinet 10 from the wall 20 without forcing a user to dissemble the anti-falling device 70 from the cabinet 10 or the wall 20, as shown in FIG. 6.

That is, when the cabinet 10 is moved away from the wall 20 to create a substantial space between the cabinet 10 and the wall 20, the guide member 90 allows the guide pin 93 to move forward along with the cabinet 10 under the guide of the guide channel 93. The anti-falling device 70 allows a movement of the cabinet 10 relative to the wall 20 without forcing a user to disassemble the anti-falling device 70 from the cabinet 10 or the wall 20. During a movement of the cabinet 10 relative to the wall 20, the hook part 91 of the guide member 90 maintains a locked state relative to the hooking part 82 of the support bracket 80, and the guide member 90 is held on the top wall of the cabinet 10 by the guide pin 93. Therefore, the anti-falling device 70 effectively prevents the cabinet 10 from falling flat on the front during such a movement of the cabinet 10 relative to the wall 20.

Thus, it is not necessary to remove the anti-falling device 70 of the second embodiment from the cabinet 10 or the wall 20 during a movement of the cabinet 10 relative to the wall 20. The anti-falling device 70 allows a user to more easily, quickly and conveniently move the cabinet 10 relative to the wall 20. In addition, the anti-falling device 70 prevents the cabinet 10 from falling flat on the front during a movement of the cabinet 10. After cleaning or repairing the rear portion of the cabinet 10, the cabinet 10 may be placed at a position close to the wall 20 by simply moving the cabinet 10 toward the wall 20 to move the guide pin 93 to a position near the rear end of the guide channel 92.

Figure 7:
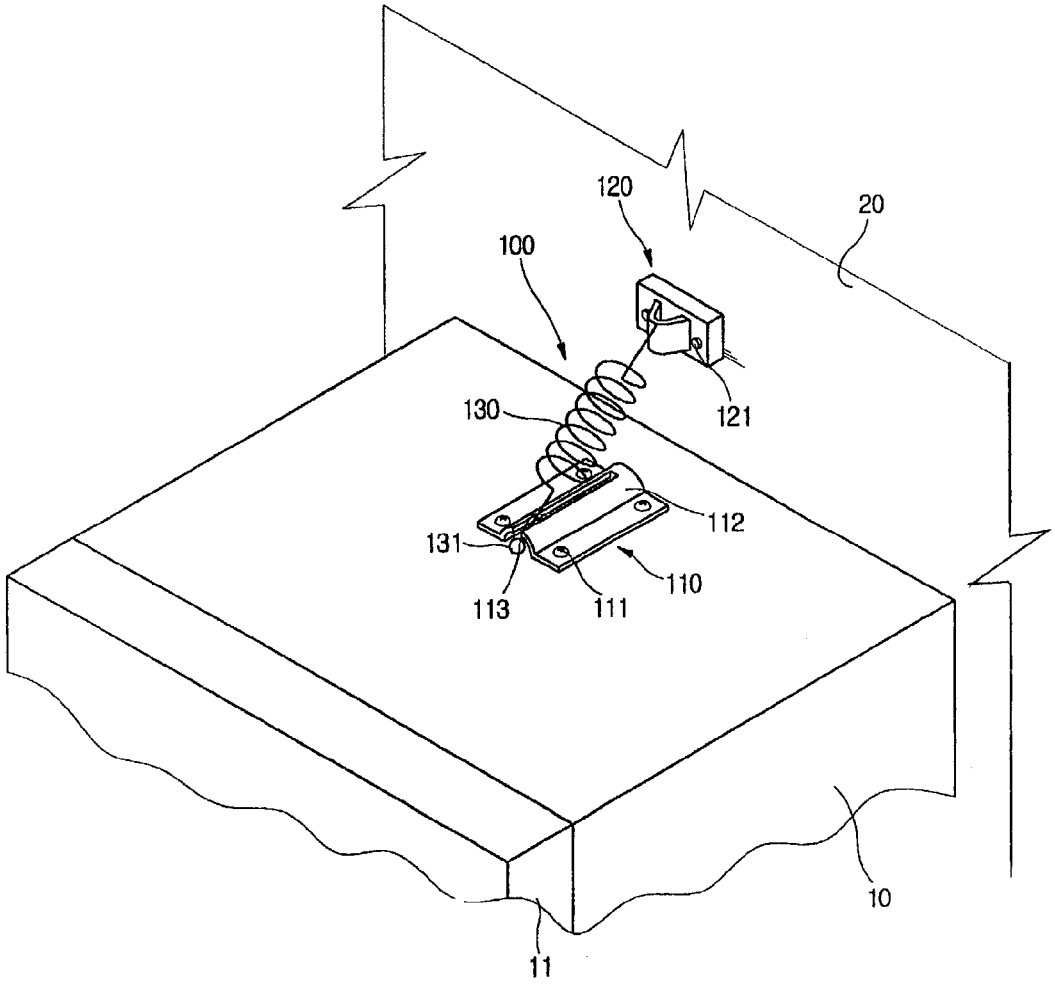
FIG. 7 is a perspective view showing construction of an anti-falling device for refrigerators in accordance with a third embodiment of the present invention.
Figure 8:
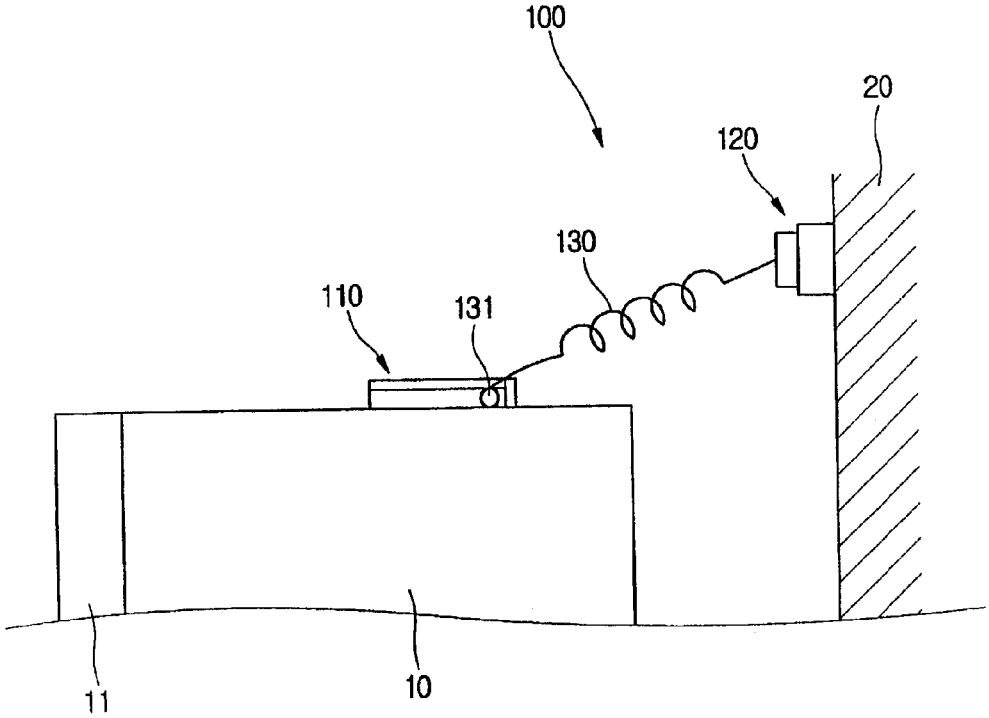
FIG. 8 is a sectional view showing construction of the anti-falling device in accordance with the third embodiment of the present invention.

An anti-falling device 100 for refrigerators in accordance with a third embodiment of the present invention will be described herein below, with reference to FIGS. 7 and 8. As shown in FIGS. 7 and 8, the anti-falling device 100 for refrigerators according to the third embodiment of the present invention includes a first support bracket 110 and a second support bracket 120. The first support bracket 110 is mounted to the top wall of a cabinet 10, and the second support bracket 120 is mounted to a wall 20 of a building at a position near the top wall of the cabinet 10. The first and second support brackets 110 and 120 of the anti-falling device 100 are mounted to the top wall of the cabinet 10 and the wall 20 of the building by using setscrews 111 and 121, respectively.

An elastic member 130 is connected to the first and second support brackets 110 and 120 to prevent the cabinet 10 from falling flat on the front. The elastic member 130 is fixedly connected at a second end thereof to the second support bracket 120 and is movably connected at a first end thereof to the first support bracket 110.

In order to allow a movable connection of the first end of the elastic member 130 to the first support bracket 110, a ball-shaped guide member 131 is provided at the first end of the elastic member 130. In addition, the first support bracket 110 bulges upward along a central axis to form a guide member reception part 112 that extends upward to define a tunnel between the first support bracket and the top wall of the cabinet 10 when the first support bracket 110 is mounted to the top wall of the cabinet 10. When connecting the first end of the elastic member 130 to the first support bracket 110, the ball-shaped guide member 131 of the elastic member 130 is movably received in the tunnel and stopped by the guide member reception part 112 of the first support bracket 110 to prevent removal of the ball-shaped guide member 131 from the first support bracket 110.

A longitudinal guide slit 113 is formed along the central axis of the guide member reception part 112 to guide a movement of the first end of the elastic member 130 along the axis of the first support bracket 110. The first support bracket 110 is arranged on the top wall of the cabinet in a direction extending from the front to the rear of the cabinet 10, and the longitudinal guide slit 113 extends in the same direction. The above guide slit 113 is open at a front end and is closed at a rear end to allow removal of the first end of the elastic member 130 having the ball-shaped guide member 131 from the guide member reception part 112 of the first support bracket 110 through the open front end of the guide slit 113. In the present invention, the width of the guide slit 113 may be selected to prevent an undesired removal of the ball-shaped guide member 131 from the first support bracket 110 through the guide slit 113. In addition, in order to allow the elastic member 130, with the ball-shaped guide member 131 stopped at the closed rear end of the guide slit 113 of the first support bracket 130, to elastically support the cabinet 10 and prevent the cabinet 10 from falling flat on the front, a compression spring may be used as the elastic member 130.

When the center of gravity of the cabinet 10 is shifted to the front of the cabinet 10, the cabinet 10 may otherwise fall flat on a front thereof. The anti-falling device 100 according to the third embodiment effectively prevents the cabinet 10 from falling flat on the front since the ball-shaped guide member 131 of the elastic member 130 may be stopped at the closed rear end of the guide slit 113 of the first support bracket 110.

When the rear portion of the cabinet 10 needs to be cleaned or repaired, the cabinet 10 is moved away from the wall 20 to create a substantial space between the rear wall of the cabinet 10 and the wall 20. Then, the anti-falling device 100 stably guides a forward movement of the cabinet 10 from the wall 20 without forcing a user to disassemble the anti-falling device 100 from the cabinet 10 or the wall 20, as shown in FIG. 8.

In the same manner as that described for the anti-falling device 70 according to the second embodiment, the anti-falling device 100 according to the third embodiment maintains the connected state of the first and second support brackets 110 and 120 by using the elastic member 130 during a forward movement of the cabinet 10 from the wall 20. Therefore, the anti-falling device 100 effectively prevents the cabinet 10 from falling flat on a front thereof during such a movement of the cabinet 10 relative to the wall 20.

As is apparent from the above description, the present invention provides an anti-falling device for refrigerators. As described for the embodiments of the present invention, the present anti-falling device has a simple construction and allows the cabinet of a refrigerator to be moved away from a wall of a building without forcing a user to disassemble the anti-falling device from the cabinet or the wall of the building. The anti-falling device of the present invention thus effectively prevents the cabinet from falling flat on a front thereof even when the center of gravity of the cabinet is shifted to the front of the cabinet due to a heavy door of the cabinet. The anti-falling device of the present invention also allows a user to move the cabinet away from a wall of a building simply and easily when the rear portion of the cabinet needs to be cleaned or repaired.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An anti-falling device for refrigerators, provided at a position between a cabinet of a refrigerator and a wall of a building against which the cabinet stands, preventing the cabinet from falling flat on a front thereof, comprising:

a hooking rod provided on the wall of the building; and a rotary hook rotatably provided on a top wall of said cabinet and engaged with or disengaged from said hooking rod in accordance with a rotation thereof, wherein said rotary hook comprises an actuating part at a second end thereof opposite to a first end having a hook part, with an elastic biasing member connecting said actuating part to a predetermined portion of a second support bracket to pull the actuating part to rotate the rotary hook around a hinge shaft in a direction opposite to the hooking rod.

2. The anti-falling device according to claim 1, further comprising:

a first support bracket mounted on the wall of the building, supporting said hooking rod; and a second support bracket mounted on the top wall of said cabinet, supporting said rotary hook.

3. The anti-falling device according to claim 2, wherein said rotary hook comprises a hook part formed by bending a first end of said rotary hook to engage with or disengage from the hooking rod, wherein the rotary hook has a hinge shaft mounted to the second support bracket and assembled with the rotary hook at an intermediate position between both ends of the rotary hook, rotatably mounting the rotary hook to the second support bracket.

4. The anti-falling device according to claim 1, wherein said second support bracket is provided at the predetermined portion thereof with an upwardly extended holding part to hold an end of said biasing member.

5. An anti-falling device for a refrigerator having a cabinet, provided at a position between a cabinet of a refrigerator and a wall of a building against which the cabinet stands, comprising:

a first member mounted to the wall of the building;

a second member provided on a top wall of the cabinet; and a third member coupling the first member to the second member and enabling relative movement of the cabinet toward and away from the wall, wherein the second member comprises a rotary hook to maintain engagement and release engagement with the third member, and wherein said rotary hook comprises an actuating part at a second end thereof opposite to a first end having a hook part, with an elastic biasing member connecting said actuating part to a predetermined portion of a second support bracket to pull the actuating part to rotate the rotary hook around a hinge shaft in a direction opposite to the third member.

6. The anti-falling device according to claim 5, wherein the first member comprises a support bracket mounted on the wall of the building.

7. The anti-falling device according to claim 6, wherein the third member comprises a hooking rod to engage the second member.

8. A method of providing an anti-falling device for a refrigerator having a cabinet, comprising:

providing a hooking rod mounted on a wall of a building; and providing a rotary hook rotatably mounted to a top wall of the cabinet, removably engagable with the hooking rod to fasten the cabinet to the wall, wherein said rotary hook comprises an actuating part at a second end thereof opposite to a first end having a hook part, with an elastic biasing member connecting said actuating part to a predetermined portion of a second support bracket to pull the actuating part to rotate the rotary hook around a hinge shaft in a direction opposite to the third member.

* * * * *